US009961472B2

(12) United States Patent
Johnson et al.

(10) Patent No.: US 9,961,472 B2
(45) **Date of Patent: *May 1, 2018**

(54) ACOUSTIC BEACON FOR BROADCASTING THE ORIENTATION OF A DEVICE

(71) Applicant: Apple Inc., Cupertino, CA (US)

(72) Inventors: Martin E. Johnson, Los Gatos, CA (US); Afrooz Family, Emerald Hills, CA (US); Tom-Davy William Jendrik Saux, Santa Clara, CA (US)

(73) Assignee: APPLE INC., Cupertino, CA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 14/775,600

(22) PCT Filed: Mar. 13, 2014

(86) PCT No.: PCT/US2014/026576

§ 371 (c)(1),
(2) Date: Sep. 11, 2015

(87) PCT Pub. No.: WO2014/151857

PCT Pub. Date: Sep. 25, 2014

(65) Prior Publication Data

US 2016/0029143 A1 Jan. 28, 2016

Related U.S. Application Data

(60) Provisional application No. 61/785,114, filed on Mar. 14, 2013.

(51) Int. Cl.
*H04R 5/02* (2006.01)
*H04S 7/00* (2006.01)

(52) U.S. Cl.
CPC ..... *H04S 7/303* (2013.01); *H04R 5/02* (2013.01); *H04S 7/301* (2013.01); *H04S 7/302* (2013.01);

(Continued)

(58) Field of Classification Search
CPC . H04S 7/03; H04S 7/301; H04S 7/302; H04S 2400/11; H04S 2400/15; H04R 5/02; H04R 2203/12

See application file for complete search history.

(56) References Cited

U.S. PATENT DOCUMENTS

2002/0136414 A1* 9/2002 Jordan ..... H04S 3/00 381/58
2005/0207592 A1* 9/2005 Sporer ..... H04S 7/30 381/94.2

(Continued)

FOREIGN PATENT DOCUMENTS

CN 101682807 3/2010
EP 1928213 A1 6/2008

(Continued)

OTHER PUBLICATIONS

PCT International Preliminary Report on Patentability for PCT International Appln No. PCT/US2014/026576 dated Sep. 24, 2015 (8 pages).

(Continued)

*Primary Examiner* — Sonia Gay
(74) *Attorney, Agent, or Firm* — Womble Bond Dickinson (US) LLP

(57) ABSTRACT

A method for determining the orientation of a loudspeaker relative to a listening device is described. The method simultaneously drives each transducer to emit beam patterns corresponding to distinct orthogonal audio signals. The listening device senses sounds produced by the orthogonal audio signals and analyzes the sensed audio signal to determine the spatial orientation of the loudspeaker relative to the listening device. Other embodiments are also described.

15 Claims, 12 Drawing Sheets

(52) U.S. Cl.
CPC ..... *H04R 2203/12* (2013.01); *H04S 2400/11* (2013.01); *H04S 2400/15* (2013.01)

(56) References Cited

U.S. PATENT DOCUMENTS

| | | | | |
|---|---|---|---|---|
| 2007/0127452 | A1* | 6/2007 | Croy | H04L 41/12 370/356 |
| 2009/0028358 | A1 | 1/2009 | Suzuki | |
| 2009/0214046 | A1* | 8/2009 | Suzuki | H04S 7/301 381/17 |
| 2010/0150382 | A1* | 6/2010 | Ko | H04R 3/12 381/303 |
| 2010/0310080 | A1 | 12/2010 | Fukuyama | |
| 2011/0091055 | A1* | 4/2011 | LeBlanc | H04S 7/301 381/303 |
| 2012/0288124 | A1* | 11/2012 | Fejzo | H04R 5/02 381/303 |
| 2013/0058492 | A1* | 3/2013 | Silzle | H04R 5/027 381/59 |

FOREIGN PATENT DOCUMENTS

| | | | |
|---|---|---|---|
| EP | 2393313 | A2 | 12/2011 |
| EP | 1928213 | | 8/2012 |
| JP | 20100213031 | | 9/2010 |
| JP | 2011-172074 | A | 9/2011 |
| WO | WO 2011/145030 | A1 | 11/2011 |

OTHER PUBLICATIONS

AU Patent Examination Report No. 1 (dated Dec. 14, 2015) AU Patent Application No. 2014236806, filed Mar. 13, 2014, (dated Dec. 14, 2015), 3.

Republic of China Office Action (dated Jun. 27, 2016), Application No. 201480022796.9, Date Filed: Mar. 13, 2014, 19 pages.

PCT International Search Report and Written Opinion for PCT International Appln No. PCT/US2014/026576 filed on Mar. 13, 2014 (12 pages).

Asano, et al. "Sound Source Localization and Separation in Near Field," *IEICE Transactions on Fundamentals of Electronics, Communications and Computer Sciences*, Engineering Sciences Society, Tokyo, JP vol. E83-A, No. 11, Nov. 1, 2000 (pp. 2286-2294).

International Preliminary Report on Patentability and Written Opinion, dated Sep. 24, 2015, Application No. PCT/US2014/026576.

Japanese Office Action dated Oct. 17, 2016 for Patent Application No. 2016-502183 (with English translation).

Chan, Yiu-Tong, et al., "Time-of-Arrival Based Localization Under NLOS Conditions", *IEEE Transactions on Vehicular Technology*, vol. 55, No. 1, (Jan. 2006), 17-24.

* cited by examiner

ACOUSTIC BEACON FOR BROADCASTING THE ORIENTATION OF A DEVICE

RELATED MATTERS

This application is a U.S. National Phase Application under 35 U.S.C. § 371 of International Application No. PCT/US2014/026576, filed Mar. 13, 2014, which claims the benefit of the earlier filing date of U.S. provisional application No. 61/785,114, filed Mar. 14, 2013.

FIELD

A system and method for determining the orientation of an audio output device relative to a listening device by analyzing orthogonal audio signals emitted by a plurality of transducers integrated or otherwise coupled to the audio output device. Other embodiments are also described.

BACKGROUND

Audio output devices may include two or more transducers for cooperatively producing sound. Although sound engineers may intend for the audio output devices to be oriented in a particular fashion relative to the listener, this orientation is not always achieved. For example, a listener may be seated off center relative to a linear loudspeaker array. In another example, a circular loudspeaker array may be placed at various angles relative to the listener. By being in a non-ideal position, sounds produced by audio output devices may achieve unintended and poor results.

SUMMARY

An embodiment of the invention relates to a method for determining the orientation of a loudspeaker array or any device with multiple transducers relative to a listening device. In one embodiment, the method simultaneously drives each transducer to emit beam patterns corresponding to distinct orthogonal audio signals. The listening device senses sounds produced by the orthogonal audio signal based beam patterns and analyzes the sensed audio signal to determine the spatial orientation of the loudspeaker array relative to the listening device.

In one embodiment, the sensed audio signal is convolved with each orthogonal test signal to produce a set of cross-correlation signals. Peaks in the cross-correlation signals are compared or otherwise analyzed to determine orientation of each transducer, quadrant, or side of the loudspeaker array relative to the listening device. In one embodiment, the size of the peaks and time separation between peaks are used to determine spatial relationships between the transducers, quadrants, or sides of the loudspeaker array relative to the listening device.

The method allows for the simultaneous examination of the orientation of multiple sides or quadrants of a loudspeaker array through the use of orthogonal test signals. By allowing multiple simultaneous analyses, the method allows for a more accurate orientation determination in a greatly reduced period of time in comparison to sequentially driving the transducers. By quickly determining orientation of the loudspeaker array relative to the listening device, immediate and continual adjustment of sound produced by the loudspeaker array may be performed. For example, an audio receiver may adjust one or more beam patterns emitted by the loudspeaker array upon determining that the listening device (and by inference the listener/user) is seated to the left of the loudspeaker array. Driving all of the transducers in the loudspeaker array simultaneously and accordingly taking all of the measurements simultaneously also avoids problems due to the movement of the listening/measurement device between measurements, because all measurements are taken at the same time.

Further, by using orthogonal audio signals, the method for determining orientation of the loudspeaker array is more robust to extraneous sounds. For example, the audio receiver may determine orientation of the loudspeaker array while simultaneously playing an audio track without affecting the orientation determination process.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments are described with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1A:
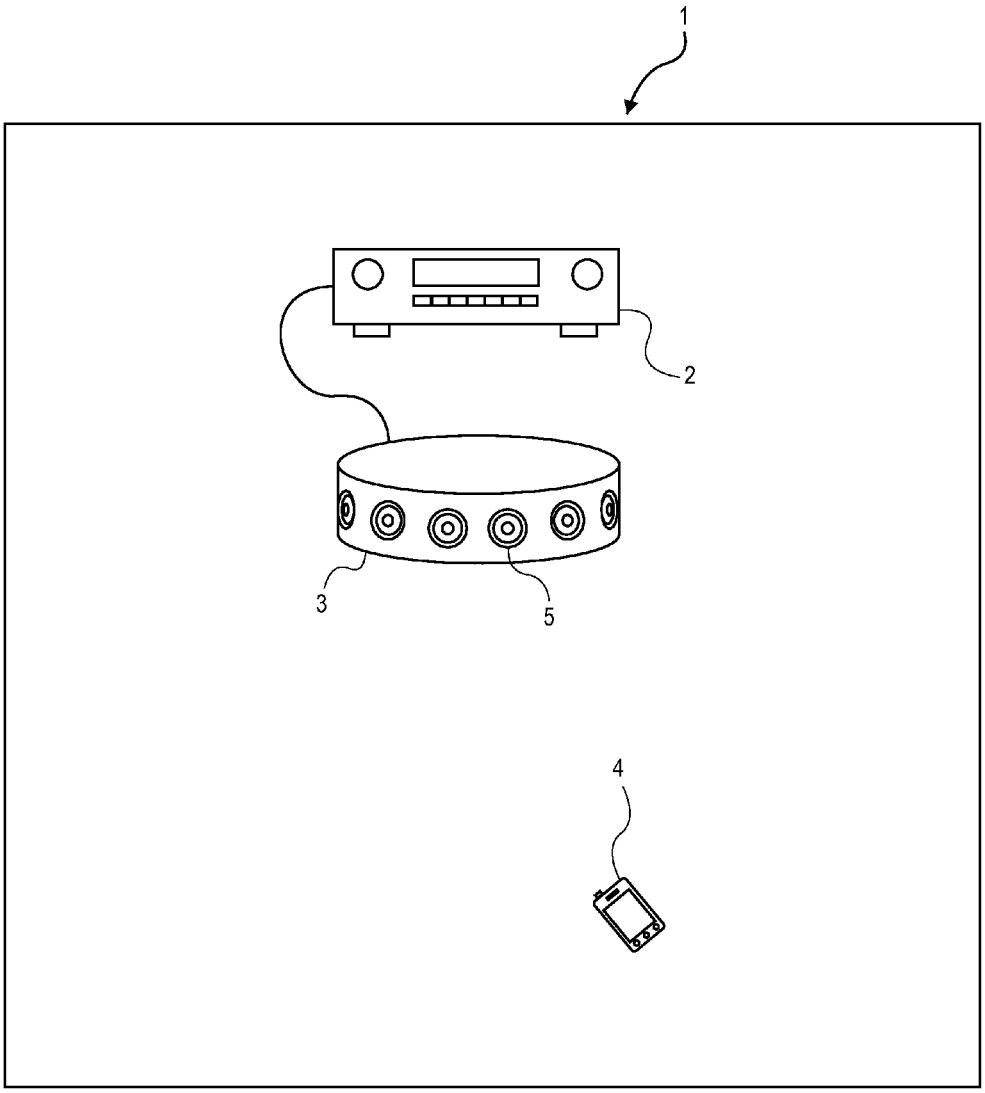
FIG. 1A shows a view of a listening area with an audio receiver, a curved loudspeaker array, and a listening device according to one embodiment.

FIG. 1A shows a view of a listening area 1 with an audio receiver 2, a loudspeaker array 3, and a listening device 4. The audio receiver 2 may be coupled to the loudspeaker array 3 to drive individual transducers 5 in the loudspeaker array 3 to emit various sound patterns into the listening area 1. The listening device 4 may sense these sounds produced by the audio receiver 2 and the loudspeaker array 3 using one or more microphones. These sensed sounds may be used to determine the orientation of the loudspeaker array 3 relative to the listening device 4 as will be described in further detail below.

Although shown with a single loudspeaker array 3, in other embodiments multiple loudspeaker arrays 3 may be coupled to the audio receiver 2. For example, three loudspeaker arrays 3 may be positioned in the listening area 1 to respectively represent front left, front right, and front center channels of a piece of sound program content (e.g., a musical composition or an audio track for a movie).

As shown in FIG. 1A, the loudspeaker array 3 houses multiple transducers 5 in a curved cabinet. FIG. 2 shows an overhead, cutaway view of the loudspeaker array 3 from FIG. 1A. Although the transducers 5 in this embodiment are situated in a circle, in other embodiments different curved arrangements may be used. For example, the transducers 5 may be arranged in a semi-circle, a sphere, an ellipse, or any type of arc. In another embodiment, as shown in FIG. 1B, the loudspeaker array 3 may be linear.

Figure 1B:
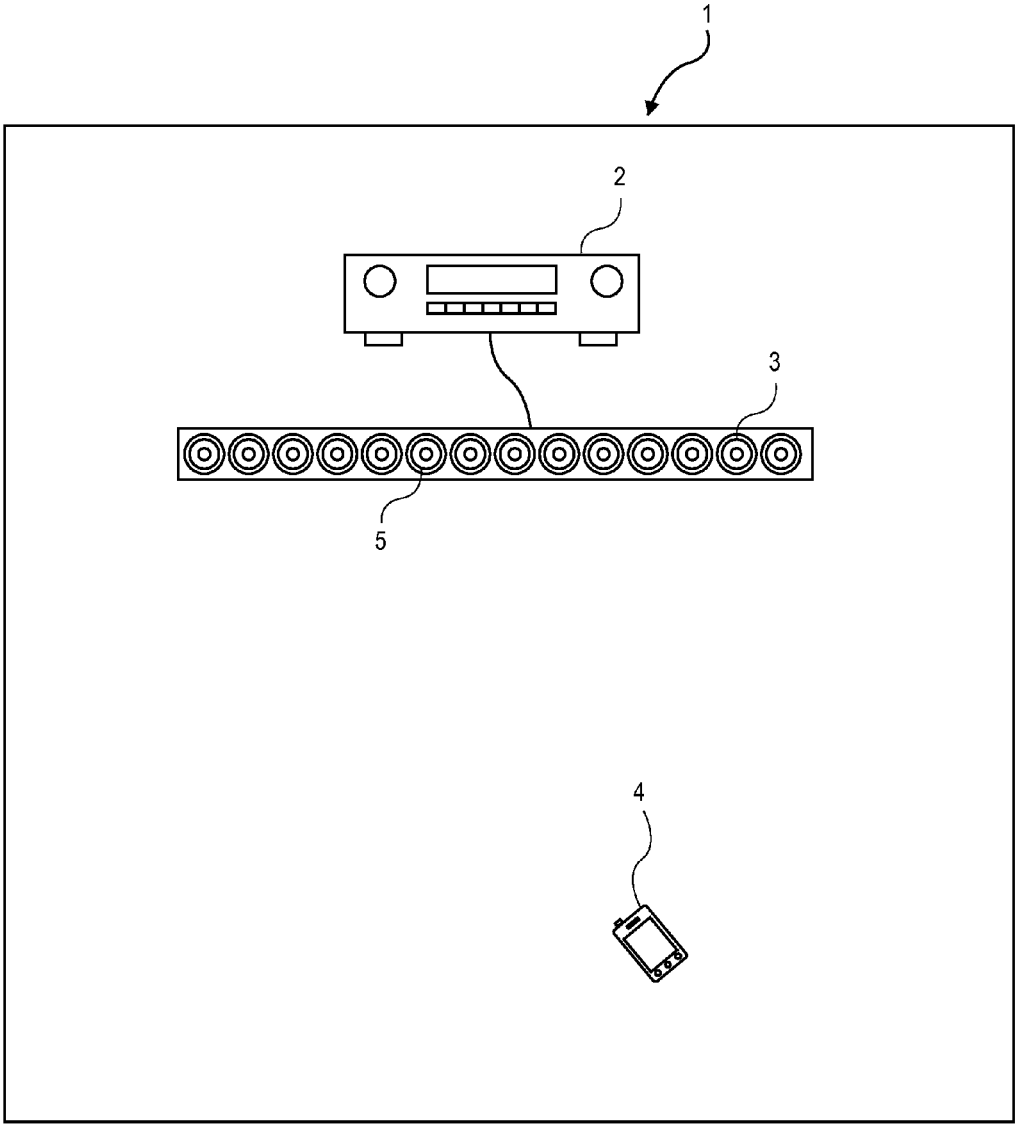
FIG. 1B shows a view of a listening area with an audio receiver, a linear loudspeaker array, and a listening device according to one embodiment.
Figure 2:
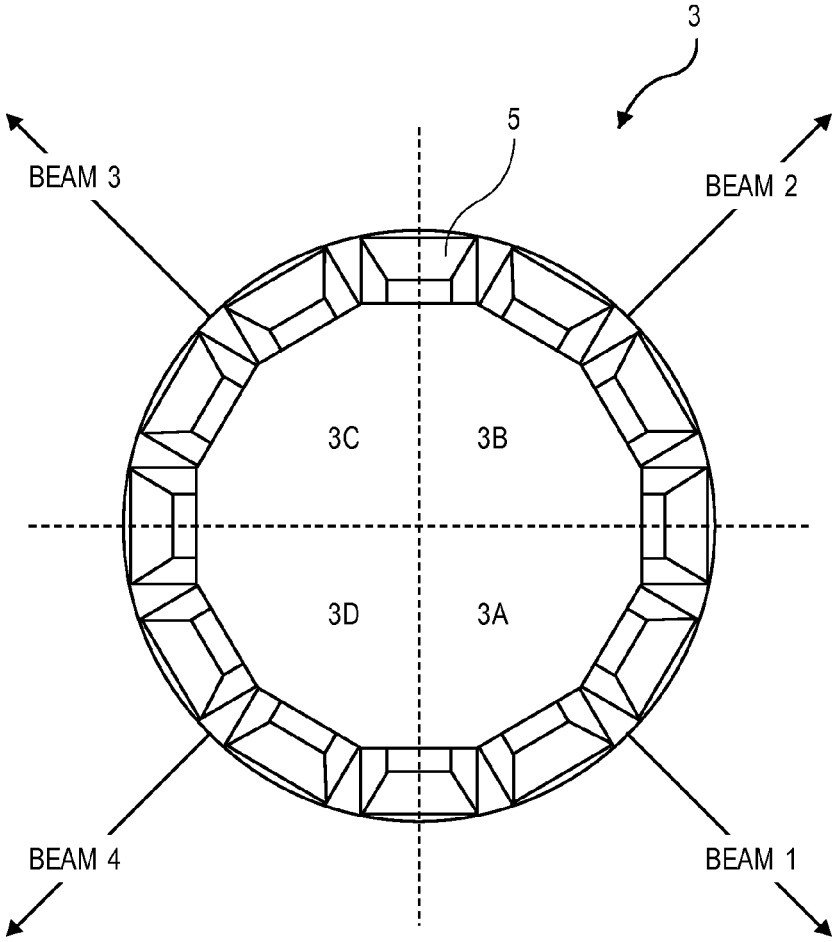
FIG. 2 shows an overhead, cutaway view of the loudspeaker array from FIG. 1A according to one embodiment.

In FIGS. 1A, 1B, and 2, the loudspeaker arrays 3 include a set of transducers 5 arranged in a single row. In another embodiment, the loudspeaker array 3 may contain multiple rows of transducers 5. The transducers 5 may be any combination of full-range drivers, mid-range drivers, subwoofers, woofers, and tweeters. Each of the transducers 5 may use a lightweight diaphragm, or cone, connected to a rigid basket, or frame, via a flexible suspension that constrains a coil of wire (e.g., a voice coil) to move axially through a cylindrical magnetic gap. When an electrical audio signal is applied to the voice coil, a magnetic field is created by the electric current in the voice coil, making it a variable electromagnet. The coil and the transducers' 5 magnetic system interact, generating a mechanical force that causes the coil (and thus, the attached cone) to move back and forth, thereby reproducing sound under the control of the applied electrical audio signal coming from an audio source, such as the audio receiver 2. Although electromagnetic dynamic loudspeaker drivers are described for use as the transducers 5, those skilled in the art will recognize that other types of loudspeaker drivers, such as piezoelectric, planar electromagnetic and electrostatic drivers are possible.

Each transducer 5 may be individually and separately driven to produce sound in response to separate and discrete audio signals received from an audio source (e.g., the audio receiver 2). By allowing the transducers 5 in the loudspeaker array 3 to be individually and separately driven according to different parameters and settings (including delays and energy levels), the loudspeaker array 3 may produce numerous directivity/beam patterns that accurately represent each channel of a piece of sound program content output by the audio receiver 2. Further, these directivity/beam patterns may be used to determine the orientation of the loudspeaker array 3 relative to the listening device 4 as discussed below.

As shown in FIGS. 1A and 1B, the loudspeaker array 3 is coupled to the audio receiver 2 through the use of wires or conduit. For example, the loudspeaker array 3 may include two wiring points and the audio receiver 2 may include complementary wiring points. The wiring points may be binding posts or spring clips on the back of the loudspeaker array 3 and the audio receiver 2, respectively. These wires are separately wrapped around or are otherwise coupled to respective wiring points to electrically couple the loudspeaker array 3 to the audio receiver 2.

In other embodiments, the loudspeaker array 3 is coupled to the audio receiver 2 using wireless protocols such that the array 3 and the audio receiver 2 are not physically joined but maintain a radio-frequency connection. For example, the loudspeaker array 3 may include WiFi or BLUETOOTH receivers for receiving audio signals from a corresponding WiFi and/or BLUETOOTH transmitter in the audio receiver 2. In some embodiments, the loudspeaker array 3 may include integrated amplifiers for driving the transducers 5 using the wireless signals received from the audio receiver 2. Although shown with a single loudspeaker array 3, in other embodiments multiple loudspeaker arrays 3 may be coupled to the audio receiver 2.

In one embodiment, the loudspeaker array 3 is used to represent front left, front right, and front center audio channels of a piece of sound program content. The sound program content may be stored in the audio receiver 2 or on an external device (e.g., a laptop computer, a desktop computer, a tablet computer, a remote streaming system, or a broadcast system) and transmitted or accessible to the audio receiver 2 through a wired or wireless connection As noted above, the loudspeaker array 3 emits sound into the listening area 1. The listening area 1 is a location in which the loudspeaker array 3 is located and in which a listener is positioned to listen to sound emitted by the loudspeaker array 3. For example, the listening area 1 may be a room within a house or commercial establishment or an outdoor area (e.g., an amphitheater). The listener may be holding the listening device 4 such that the listening device 4 is able to sense similar or identical sounds from the loudspeaker array 3, including level, pitch and timbre, perceivable by the listener.

Although described in relation to dedicated speakers, the loudspeaker array 3 may be any audio output device that houses multiple transducers 5. The multiple transducers 5 in these embodiments may not be arranged in an array. For example, the loudspeaker array 3 may be replaced by a laptop computer, a mobile audio device, a mobile phone, or a tablet computer with multiple transducers 5 for outputting sound.

Figure 3:
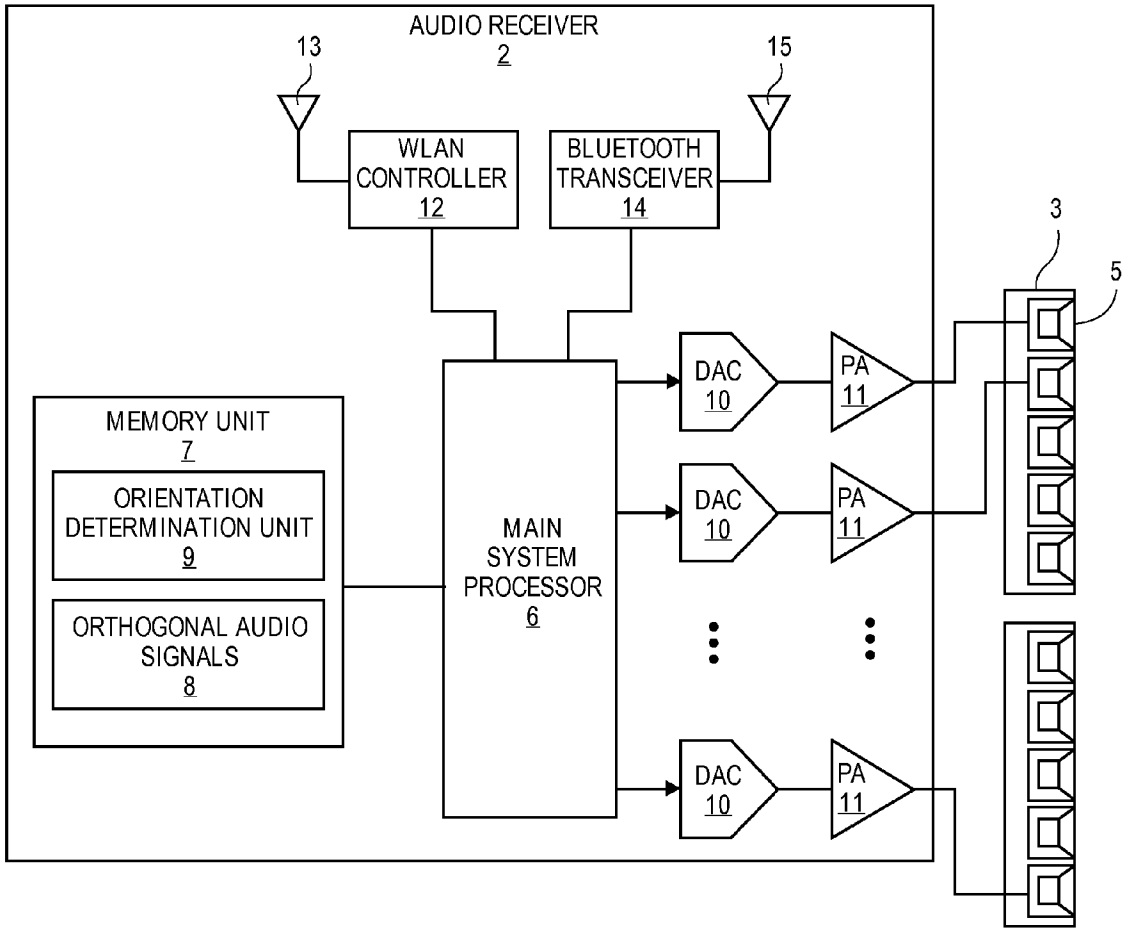
FIG. 3 shows a functional unit block diagram and some constituent hardware components of the audio receiver according to one embodiment.

FIG. 3 shows a functional unit block diagram and some constituent hardware components of the audio receiver 2 according to one embodiment. Although shown as separate, in one embodiment the audio receiver 2 is integrated within the loudspeaker array 3. The components shown in FIG. 3 are representative of elements included in the audio receiver 2 and should not be construed as precluding other components. Each element of the audio receiver 2 will be described by way of example below.

The audio receiver 2 may include a main system processor 6 and memory unit 7. The processor 6 and memory unit 7 are generically used here to refer to any suitable combination of programmable data processing components and data storage that conduct the operations needed to implement the various functions and operations of the audio receiver 2. The processor 6 may be a special purpose processor such as an application-specific integrated circuit (ASIC), a general purpose microprocessor, a field-programmable gate array (FPGA), a digital signal controller, or a set of hardware logic structures (e.g., filters, arithmetic logic units, and dedicated state machines) while the memory unit 7 may refer to microelectronic, non-volatile random access memory. An operating system may be stored in the memory unit 7, along with application programs specific to the various functions of the audio receiver 2, which are to be run or executed by the processor 6 to perform the various functions of the audio receiver 2. For example, the audio receiver 2 may include an orientation determination unit 9, which in conjunction with other hardware elements of the audio receiver 2, drive individual transducers 5 in the loudspeaker array 3 to emit sound.

In one embodiment, the audio receiver 2 may include a set of orthogonal audio signals 8. The orthogonal audio signals 8 may be pseudorandom binary sequences, such as maximum length sequences. The pseudorandom noise sequences are signals similar to noise which satisfy one or more of the standard tests for statistical randomness. In one embodiment, the orthogonal audio signals 8 may be generated using a linear shift register. Taps of the shift register would be set differently for different sides of the loudspeaker array 3, thus ensuring that the generated orthogonal audio signal 8 for each side of the loudspeaker array 3 is highly orthogonal to all other orthogonal audio signals 8. The orthogonal audio signals 8 may be binary sequences with lengths of $2^{N-1}$, where N is the number of transducers 5 being simultaneously driven.

In one embodiment, each of the one or more orthogonal audio signals 8 is associated with a single side, quadrant, or direction of the loudspeaker array 3. For example, the loudspeaker array 3 shown in FIG. 2 may be split up into four quadrants/sides 3A-3D as shown. Each quadrant may be associated with a single distinct orthogonal audio signal 8. In this example, there would be four distinct orthogonal audio signals 8 associated with each quadrant 3A-3D of the loudspeaker array 3. The orthogonal audio signals 8 may be stored in the memory unit 7 or another storage unit integrated or accessible to the audio receiver 2. The orthogonal audio signals 8 may be used to determine the orientation of the loudspeaker array 3 relative to the listening device 4 as will be described in further detail below.

In one embodiment, the main system processor 6 retrieves one or more of the orthogonal audio signals 8 in response to a request to determine the orientation of the loudspeaker array 3 relative to the listening device 4. The request may be instigated by a remote device (e.g., the listening device 4) or a component within the audio receiver 2. For example, the main system processor 6 may begin a procedure for determining the orientation of the loudspeaker array 3 (e.g., a procedure defined by the orientation determination unit 9) by retrieving one or more of the orthogonal audio signals 8 in response to a user selecting a test button on the audio receiver 2. In another embodiment, the main system processor 6 may periodically retrieve one or more of the orthogonal audio signals 8 to determine the orientation of the loudspeaker array 3 relative to the listening device 4 at a prescribed interval (e.g., every minute).

The main system processor 6 may create driving signals based on the orthogonal audio signals 8. The driving signals generate beam patterns for each of the orthogonal audio signals 8. For example, the main system processor 6 may create a set of driving signals corresponding to a highly directed beam pattern for each orthogonal audio signal 8. The beam patterns are directed along specified quadrants/directions 3A-3D associated with each orthogonal audio signal 8. FIG. 2 shows the centerlines of four beam patterns for orthogonal audio signals 8 associated with separate quadrants 3A-3D of the loudspeaker array 3. The driving signals may be used to drive the transducers 5 to simultaneously produce each beam pattern. The audio receiver 2 may also include one or more digital-to-analog converters 10 to produce one or more distinct analog signals based on the driving signals. The analog signals produced by the digital-to-analog converters 10 are fed to the power amplifiers 11 to drive corresponding transducers 5 in the loudspeaker array 3 such that the transducers 5 collectively emit beam patterns associated with each orthogonal audio signal 8. As will be described in further detail below, the listening device 4 may simultaneously sense the sounds produced by each beam pattern using one or more microphones. These sensed signals may be used to determine the orientation of the loudspeaker array 3 relative to the listening device 4.

In one embodiment, the audio receiver 2 may also include a wireless local area network (WLAN) controller 12 that receives and transmits data packets from a nearby wireless router, access point, and/or other device, using antenna 13. The WLAN controller 12 may facilitate communications between the audio receiver 2 and the listening device 4 and/or the loudspeaker array 3 through an intermediate component (e.g., a router or a hub). In one embodiment, the audio receiver 2 may also include a BLUETOOTH transceiver 14 with an associated antenna 15 for communicating with the listening device 4, the loudspeaker array 3, and/or another device.

Figure 4:
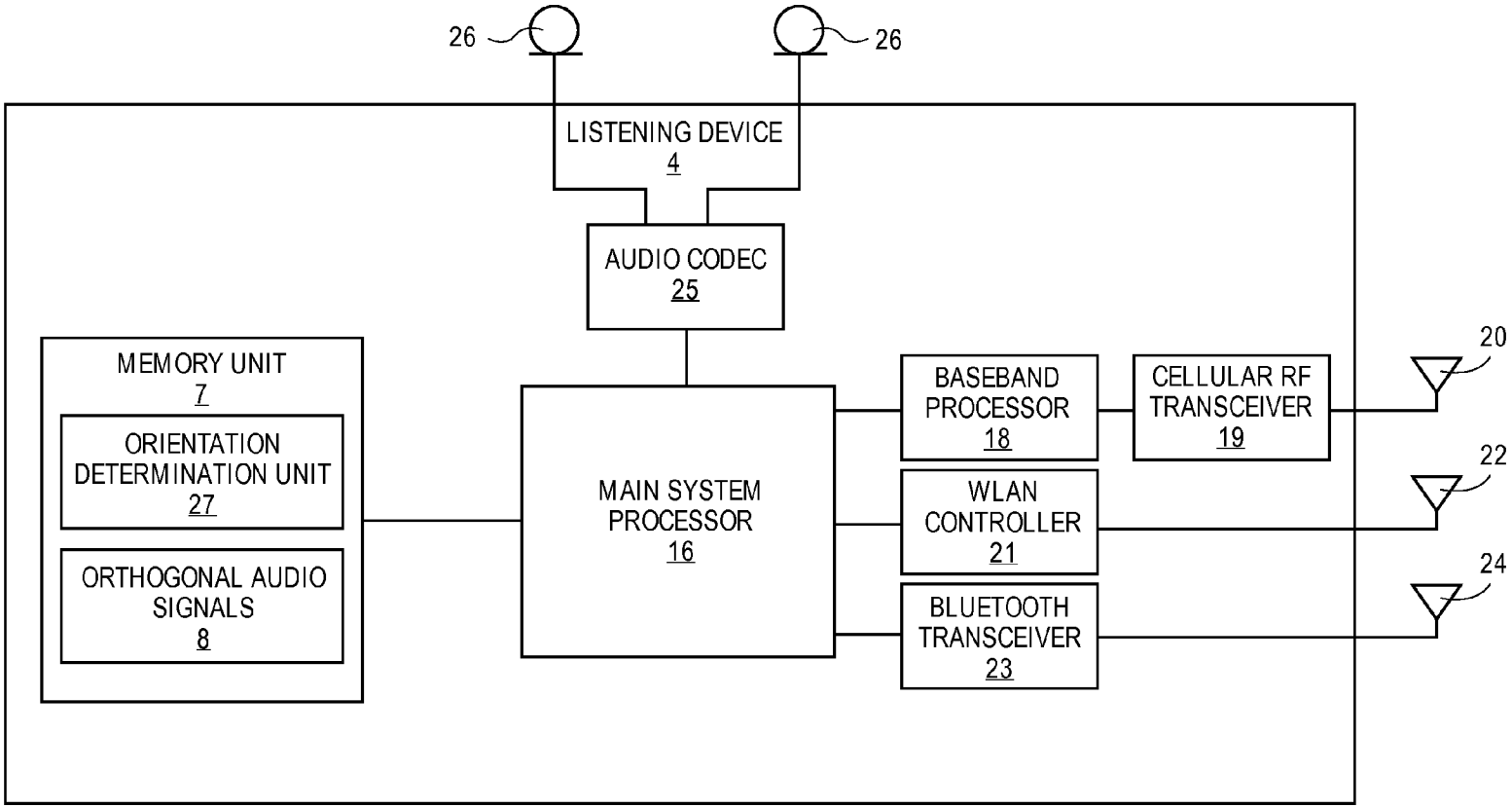
FIG. 4 shows a functional unit block diagram and some constituent hardware components of the listening device according to one embodiment.

FIG. 4 shows a functional unit block diagram and some constituent hardware components of the listening device 4 according to one embodiment. The components shown in FIG. 4 are representative of elements included in the listening device 4 and should not be construed as precluding other components. Each element of the listening device 4 will be described by way of example below.

The listening device 4 may include a main system processor 16 and a memory unit 17. The processor 16 and the memory unit 17 are generically used here to refer to any suitable combination of programmable data processing components and data storage that conduct the operations needed to implement the various functions and operations of the listening device 4. The processor 16 may be an applications processor typically found in a smart phone, while the memory unit 17 may refer to microelectronic, non-volatile random access memory. An operating system may be stored in the memory unit 17, along with application programs specific to the various functions of the listening device 4, which are to be run or executed by the processor 16 to perform the various functions of the listening device 4. For instance, there may be a telephony application that (when launched, unsuspended, or brought to foreground) enables the user to "dial" a telephone number to initiate a telephone call using a wireless VOIP or a cellular protocol and to "hang up" on the call when finished.

In one embodiment, the listening device 4 may include a baseband processor 18 to perform speech coding and decoding functions upon the uplink and downlink signals, respectively, in accordance with the specifications of a given protocol (e.g., cellular GSM, cellular CDMA, wireless VOIP). A cellular RF transceiver 19 receives the coded uplink signal from the baseband processor 18 and up converts it to a carrier band before driving antenna 20 with it. Similarly, the RF transceiver 19 receives a downlink signal from the antenna 20 and down converts the signal to baseband before passing it to the baseband processor 18.

In one embodiment, the listening device 4 may also include a wireless local area network (WLAN) controller 21 that receives and transmits data packets from a nearby wireless router, access point, and/or other device using an antenna 22. The WLAN controller 21 may facilitate communications between the audio receiver 2 and the listening device 4 through an intermediate component (e.g., a router or a hub). In one embodiment, the listening device 4 may also include a BLUETOOTH transceiver 23 with an associated antenna 24 for communicating with the audio receiver 2. For example, the listening device 4 and the audio receiver 2 may share or synchronize data using one or more of the WLAN controller 21 and the BLUETOOTH transceiver 23.

In one embodiment, the listening device 4 may include an audio codec 25 for managing digital and analog audio signals. For example, the audio codec 25 may manage input audio signals received from one or more microphones 26 coupled to the codec 25. Management of audio signals received from the microphones 26 may include analog-to-digital conversion and general signal processing. The microphones 26 may be any type of acoustic-to-electric transducer or sensor, including a MicroElectrical-Mechanical System (MEMS) microphone, a piezoelectric microphone, an electret condenser microphone, or a dynamic microphone. The microphones 26 may provide a range of polar patterns, such as cardioid, omnidirectional, and figure-eight. In one embodiment, the polar patterns of the microphones 26 may vary continuously over time. In one embodiment, the microphones 26 are integrated in the listening device 4. In another embodiment, the microphones 26 are separate from the listening device 4 and are coupled to the listening device 4 through a wired or wireless connection (e.g., BLUETOOTH and IEEE 802.11x).

In one embodiment, the listening device 4 may include the set of orthogonal audio signals 8. As noted above in relation to the audio receiver 2, each of the one or more orthogonal audio signals 8 is associated with a quadrant 3A-3D of the loudspeaker array 3. For example, the loudspeaker array 3 shown in FIG. 2 with four quadrants 3A-3D may have four distinct orthogonal audio signals 8 in a one-to-one relationship with the quadrants 3A-3D. The orthogonal audio signals 8 may be stored in the memory unit 17 or another storage unit integrated or accessible to the listening device 4. The orthogonal audio signals 8 may be used to determine the orientation of the loudspeaker array 3 relative to the listening device 4 as will be described in further detail below.

In one embodiment, the orthogonal audio signals 8 may be identical to the orthogonal audio signals 8 stored in the audio receiver 2. In this embodiment, the orthogonal audio signals 8 are shared or synchronized between the listening device 4 and the audio receiver 2 using one or more of the WLAN controllers 12 and 21 and the BLUETOOTH transceivers 14 and 23.

In one embodiment, the listening device 4 includes an orientation determination unit 27 for determining the orientation of the loudspeaker array 3 relative to the listening device 4. The orientation determination unit 27 of the listening device 4 may work in conjunction with the orientation determination unit 9 of the audio receiver 2 to determine the orientation of the loudspeaker array 3 relative to the listening device 4.

Figure 5:
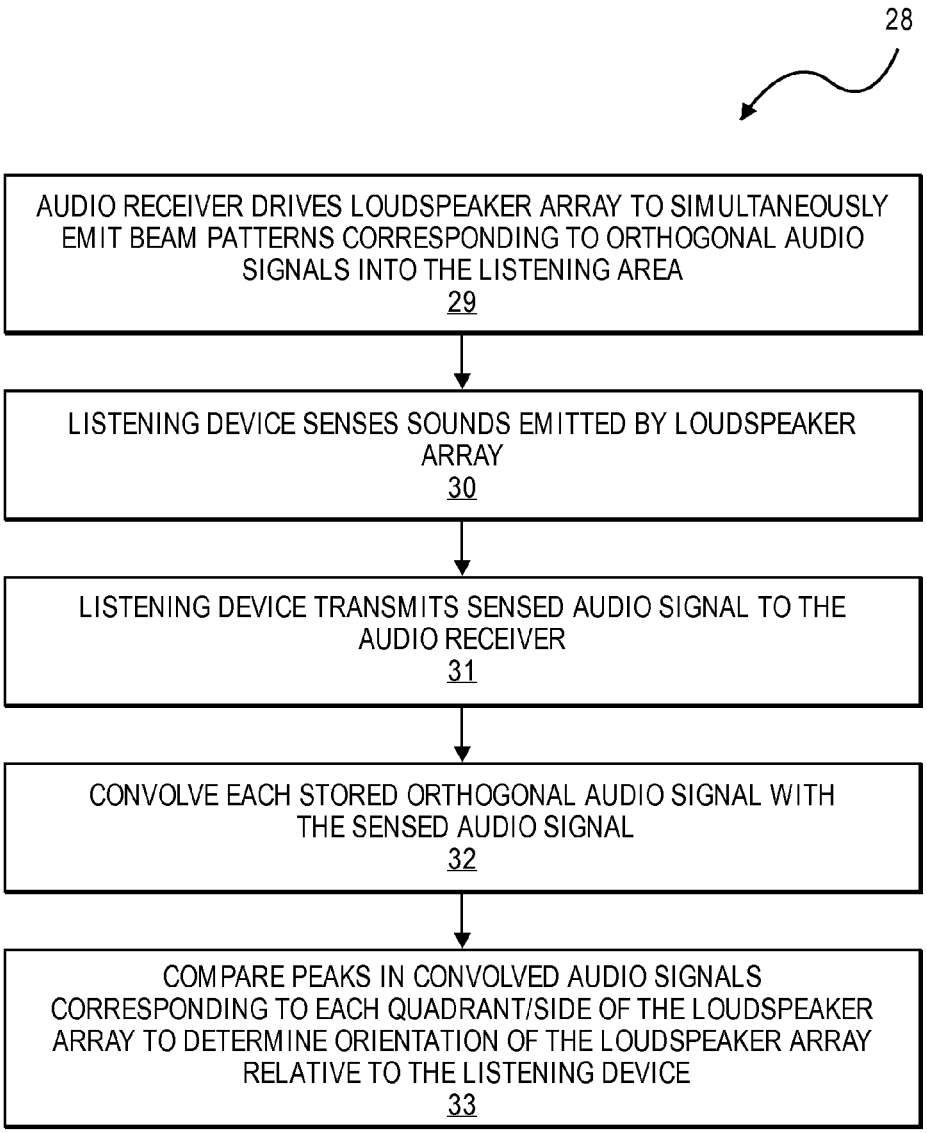
FIG. 5 shows a method for determining the orientation of the loudspeaker array relative to the listening device according to one embodiment.

FIG. 5 shows a method 28 for determining the orientation of the loudspeaker array 3 relative to the listening device 4 according to one embodiment. The method 28 may be performed by one or more components of both the audio receiver 2 and the listening device 4. In one embodiment, one or more of the operations of the method 28 are performed by the orientation determination units 9 and/or 27.

In one embodiment, the method 28 begins at operation 29 with the audio receiver 2 driving the loudspeaker array 3 to simultaneously emit multiple beam patterns based on the orthogonal audio signals 8 into the listening area 1. In some embodiments, the transducers 5 may be driven to play a superposition of different orthogonal signals 8. As noted above, the audio receiver 2 may drive the transducers 5 in the loudspeaker array 3 to emit separate beam patterns along distinct quadrants/directions 3A-3D. The relationship between each quadrant 3A-3D of the loudspeaker array 3 and the orthogonal audio signals 8 may be stored along with the orthogonal audio signals 8 in the audio receiver 2 and/or the listening device 4. For example, the following table may be stored in the audio receiver 2 and/or the listening device 4 demonstrating the relationship between each quadrant/direction in FIG. 2 and corresponding orthogonal audio signals 8:

TABLE 1

| Quadrant/Side Identifier | Orthogonal Audio Signal Identifier |
|---|---|
| 3A | 8A |
| 3B | 8B |
| 3C | 8C |
| 3D | 8D |

In one embodiment, the orthogonal audio signals 8 are ultrasound signals that are above the normal limit perceivable by humans. For example, the orthogonal audio signals 8 may be higher than 20 Hz. In this embodiment, the audio receiver 2 may drive the transducers 5 to emit beam patterns corresponding to the orthogonal audio signals 8 while simultaneously driving the transducers 5 to emit sounds corresponding to a piece of sound program content (e.g., a musical composition or an audio track for a movie). Using this methodology, the orthogonal audio signals 8 may be used to determine the orientation of the loudspeaker array 3 while the loudspeaker array 3 is being used during normal operations. Accordingly, orientation of the loudspeaker array 3 may be continually and variably determined without affecting a listener's audio experience.

At operation 30, the listening device 4 senses sounds produced by the loudspeaker array 3. Since beam patterns corresponding to each of the orthogonal audio signals 8 are simultaneously output in separate directions relative to the loudspeaker array 3, the listening device 4 generates a single sensed audio signal, which includes sounds corresponding to each of the simultaneously played orthogonal audio signals 8. For example, the listening device 4 may produce a five millisecond audio signal that includes each of the orthogonal audio signals 8. The listening device 4 may sense sounds produced by the loudspeaker array 3 using one or more of the microphones 26 in conjunction with the audio codec 25.

In one embodiment, the listening device 4 is continually recording sounds in the listening area 1. In another embodiment, the listening device 4 begins to record sounds upon being prompted by the audio receiver 2. For example, the audio receiver 2 may transmit a record command to the listening device 4 using the WLAN controllers 12 and 21 and/or the BLUETOOTH transceivers 14 and 23. The record command may be intercepted by the orientation determination unit 27, which begins recording sounds in the listening area 1.

At operation 31, the listening device 4 transmits the sensed audio signal to the audio receiver 2 for processing and orientation determination. The transmission of the sensed audio signal may be performed using the WLAN controllers 12 and 21 and/or the BLUETOOTH transceivers 14 and 23. In one embodiment, the listening device 4 performs orientation determination without assistance from the audio receiver 2. In this embodiment, the sensed audio signal is not transmitted to the audio receiver 2. Instead, the orientation determination may be performed by the listening device 4 and the orientation results are thereafter transmitted to the audio receiver 2 using the WLAN controllers 12 and 21 and/or the BLUETOOTH transceivers 14 and 23.

Figure 6A:
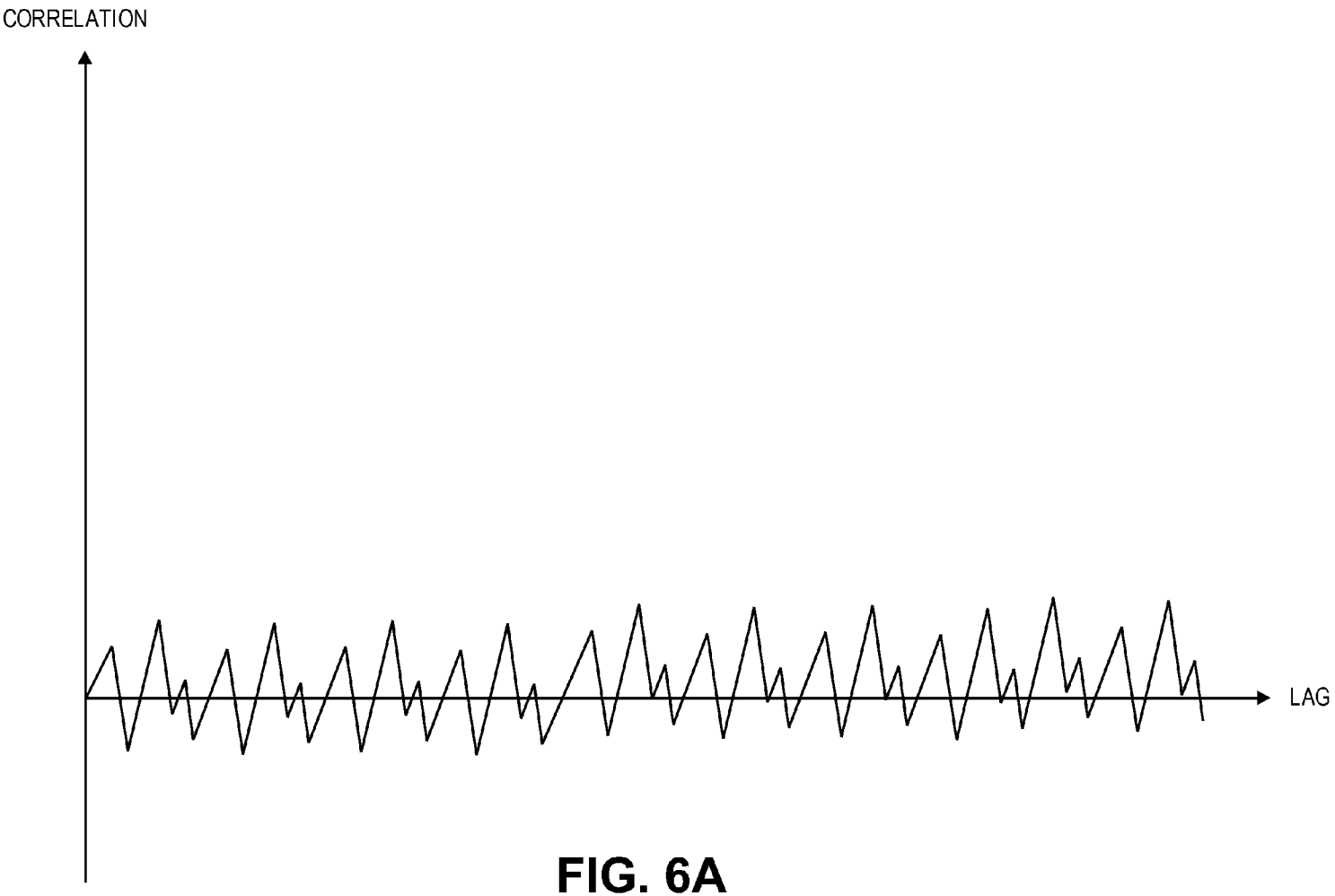
FIG. 6A shows an example of a sensed audio signal generated by the listening device according to one embodiment.
Figure 6B:
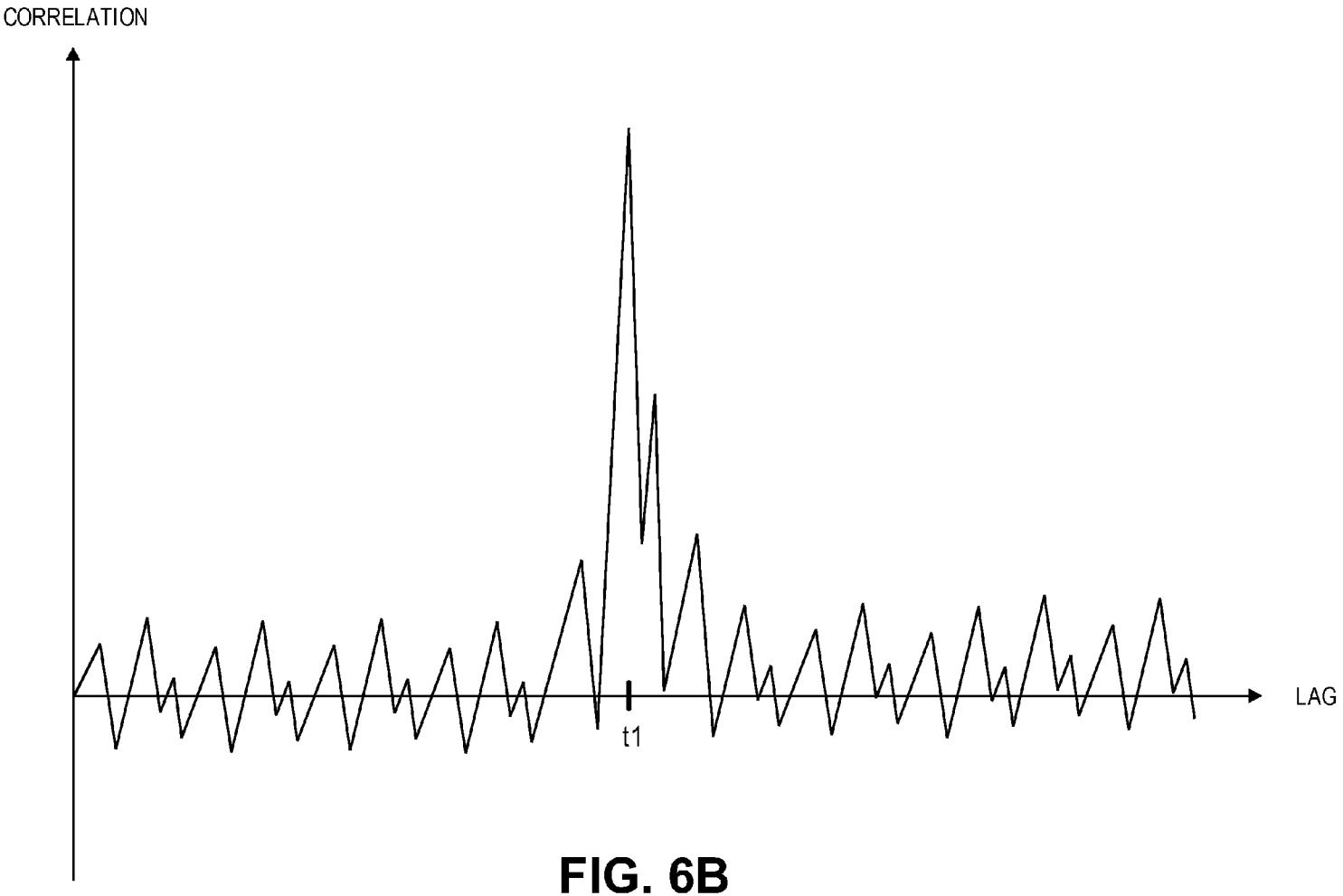
FIGS. 6B and 6C show example cross-correlation signals for orthogonal audio signals according to one embodiment.
Figure 6C:
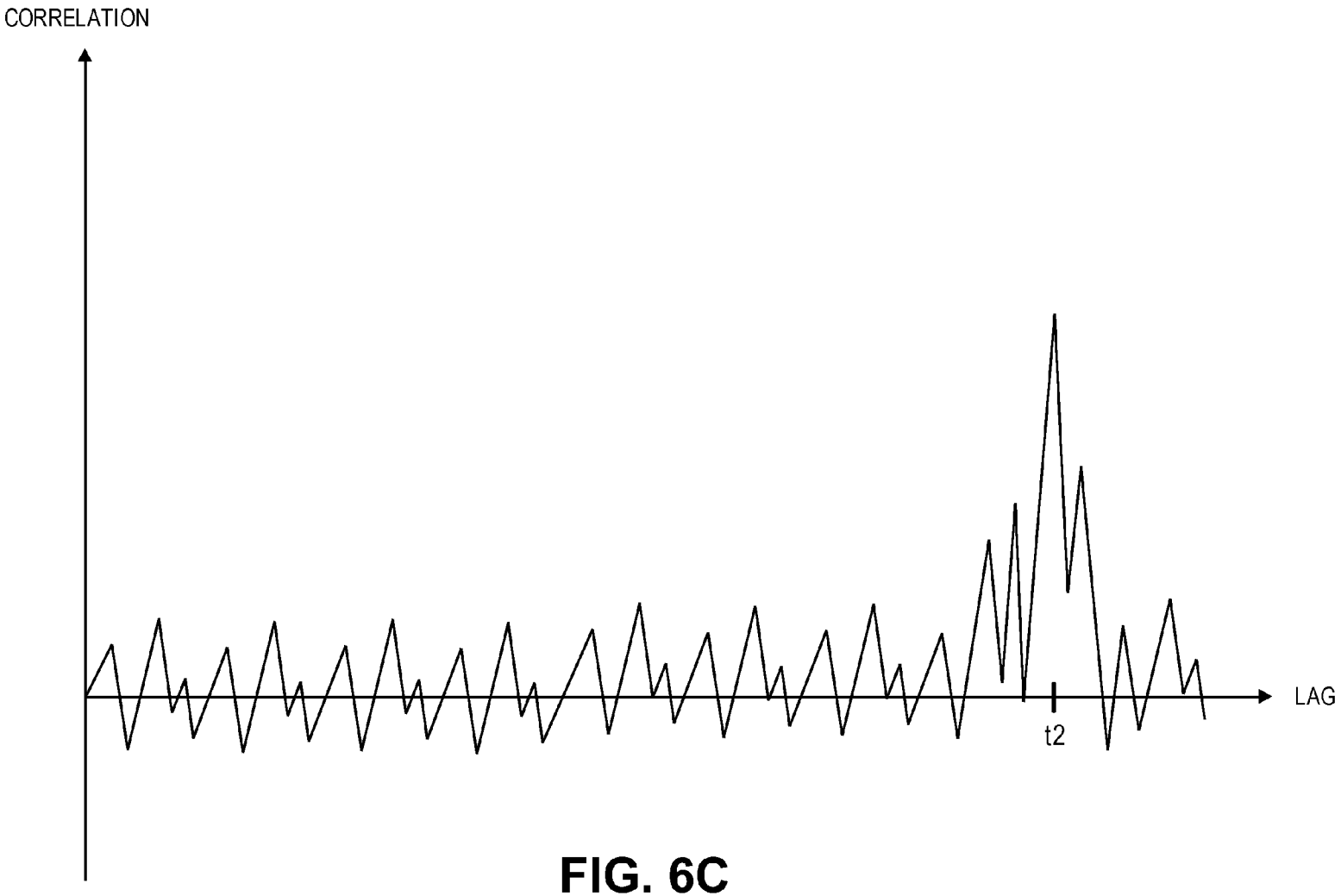

At operation 32, the sensed audio signal is convolved with each stored orthogonal audio signal 8 to produce a set of cross-correlation signals. Since the convolution is performed for each orthogonal audio signal 8, the number of cross-correlation signals will be equal to the number of orthogonal audio signals 8. Each of the cross-correlation signals corresponds to the same quadrant/side 3A-3D as its associated orthogonal audio signal (for example as shown in the Table 1). FIG. 6A shows an example sensed audio signal, while FIGS. 6B and 6C show cross-correlation signals for orthogonal audio signals 8A and 8B, which correspond to quadrants/directions 3A and 3B, respectively. The cross-correlation signals each include a peak or trough above/below the general spectral distribution. For example, the cross-correlation signals shown in FIGS. 6B and 6C respectively include peaks with varying intensities. These peaks correspond to the level, pitch, and other characteristics of respective orthogonal audio signals 8 sensed by the listening device 4 at operation 30.

Figure 7:
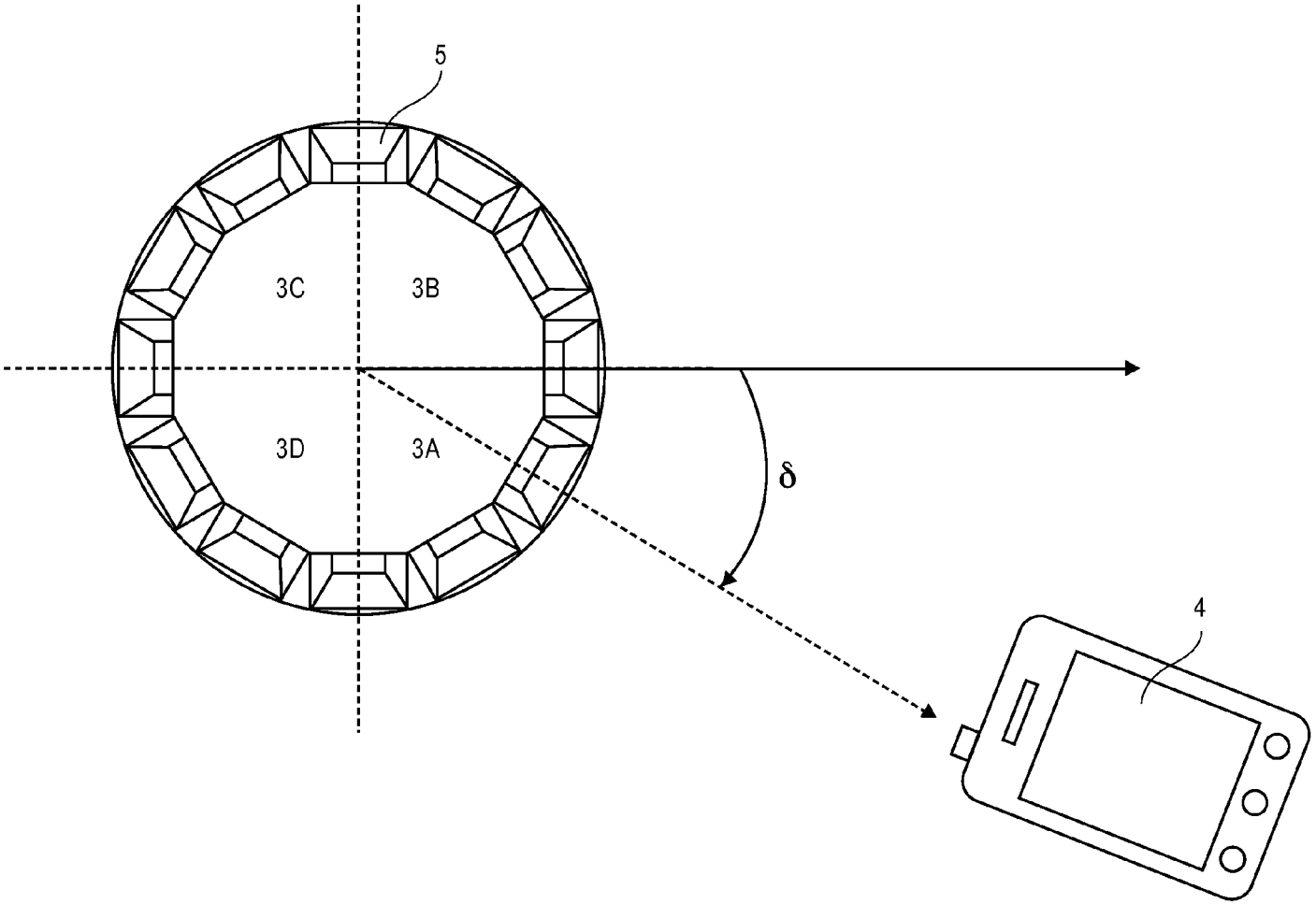
FIG. 7 shows a loudspeaker array and the array's horizontal relationship to the listening device according to one embodiment.

At operation 33, the peaks in each cross-correlation signal are compared to determine the orientation of the loudspeaker array 3 relative to the listening device 4. In one embodiment, quadrants 3A-3D corresponding to cross-correlation signals with higher peaks are determined to be closer to the listening device 4 than quadrants 3A-3D corresponding to cross-correlation signals with lower peaks. For example, the peak in FIG. 6B corresponds to quadrant 3A while the peak in FIG. 6C corresponds to quadrant 3B. In this example, the peak in FIG. 6B corresponding to quadrant 3A is larger than the peak in FIG. 6C corresponding to quadrant 3B. Based on this difference, operation 33 determines that quadrant 3A is closer to the listening device 4 than quadrant 3B. This relationship is shown in FIG. 7 where quadrant 3A is closer to the listening device 4 than quadrant 3B. Similar inferences may be made for quadrants 3C and 3D based on the size and shape of peaks in corresponding cross-correlation signals. These inferences may be combined to produce a unified orientation of the loudspeaker array 3 relative to the listening device 4. For example, as shown in FIG. 7, a unified orientation of the loudspeaker array 3 may be represented as an azimuthal measurement δ relative to an axis or a particular quadrant 3A-3D of the loudspeaker array 3. In another embodiment, the unified orientation of the loudspeaker array 3 may include an azimuthal measurement of each quadrant 3A-3D of the loudspeaker array 3 in relation to the listening device 4.

In one embodiment, the phase of each beam pattern corresponding to the orthogonal audio signals 8 is used to determine the location of the listening device 4 relative to the loudspeaker array 3. Knowing the beam patterns used to emit each of the orthogonal audio signals 8, the location of the listening device 4 relative to the emitted beam pattern may be calculated. This location within the beam pattern may thereafter be used to determine the location of the listening device 4 relative to the loudspeaker array 3.

Figure 8:
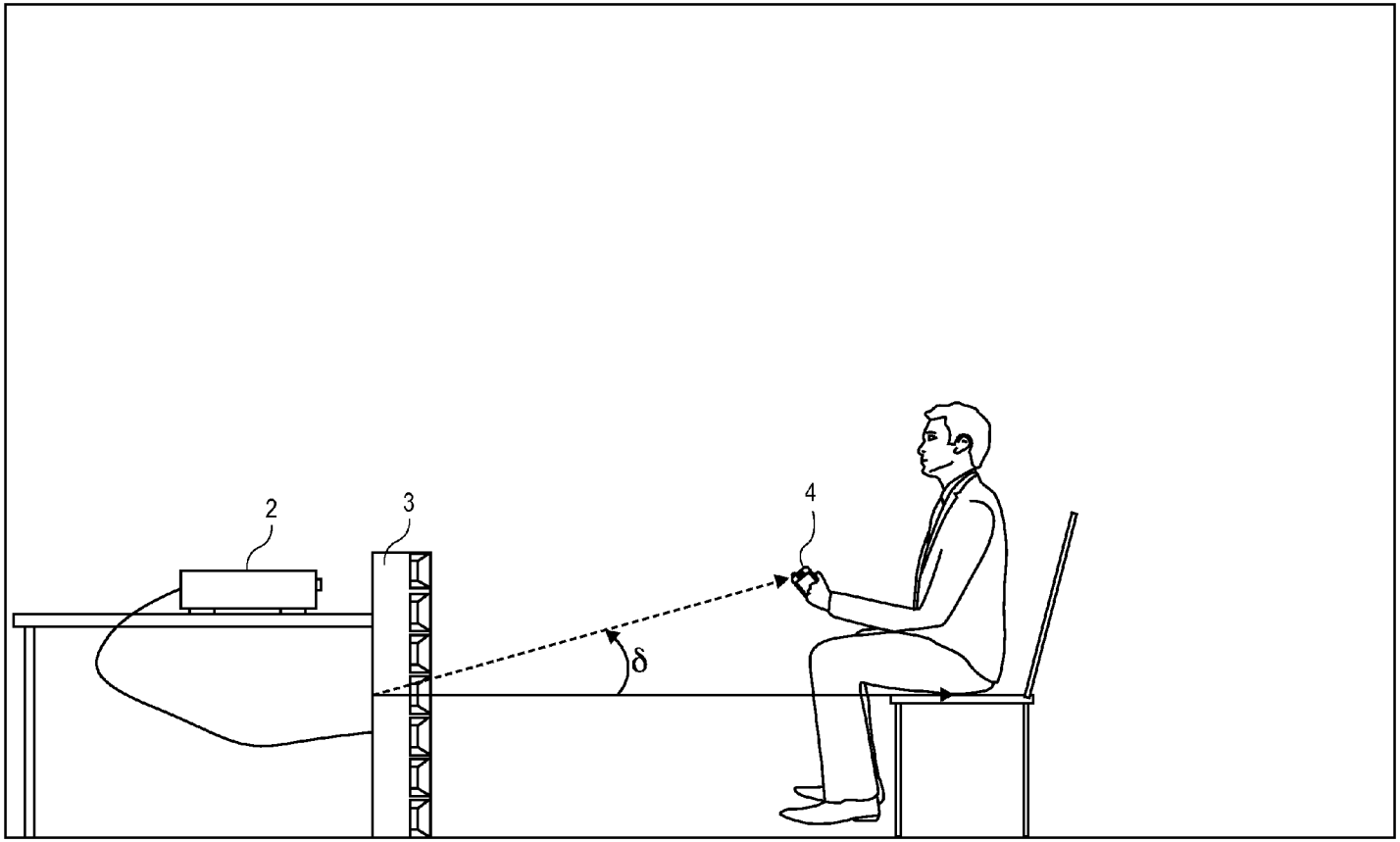
FIG. 8 shows a loudspeaker array and the array's vertical relationship to the listening device according to one embodiment.

As shown in FIG. 7, the orientation of the loudspeaker array 3 relative to the listening device 4 is determined in the horizontal direction. In other embodiments, the orientation of the loudspeaker array 3 relative to the listening device 4 may also be determined in the vertical direction. FIG. 8 shows a side view of the listening area 1 in which a listener is holding the listening device 4. In this embodiment, operation 33 determines the vertical orientation of the loudspeaker array 3 relative to the listening device 4 using similar techniques to those described above. The vertical orientation may include the vertical angles between multiple quadrants/sides of the loudspeaker array 2 and/or the acoustic center of the array 3 and the listening device 4.

Figure 9:
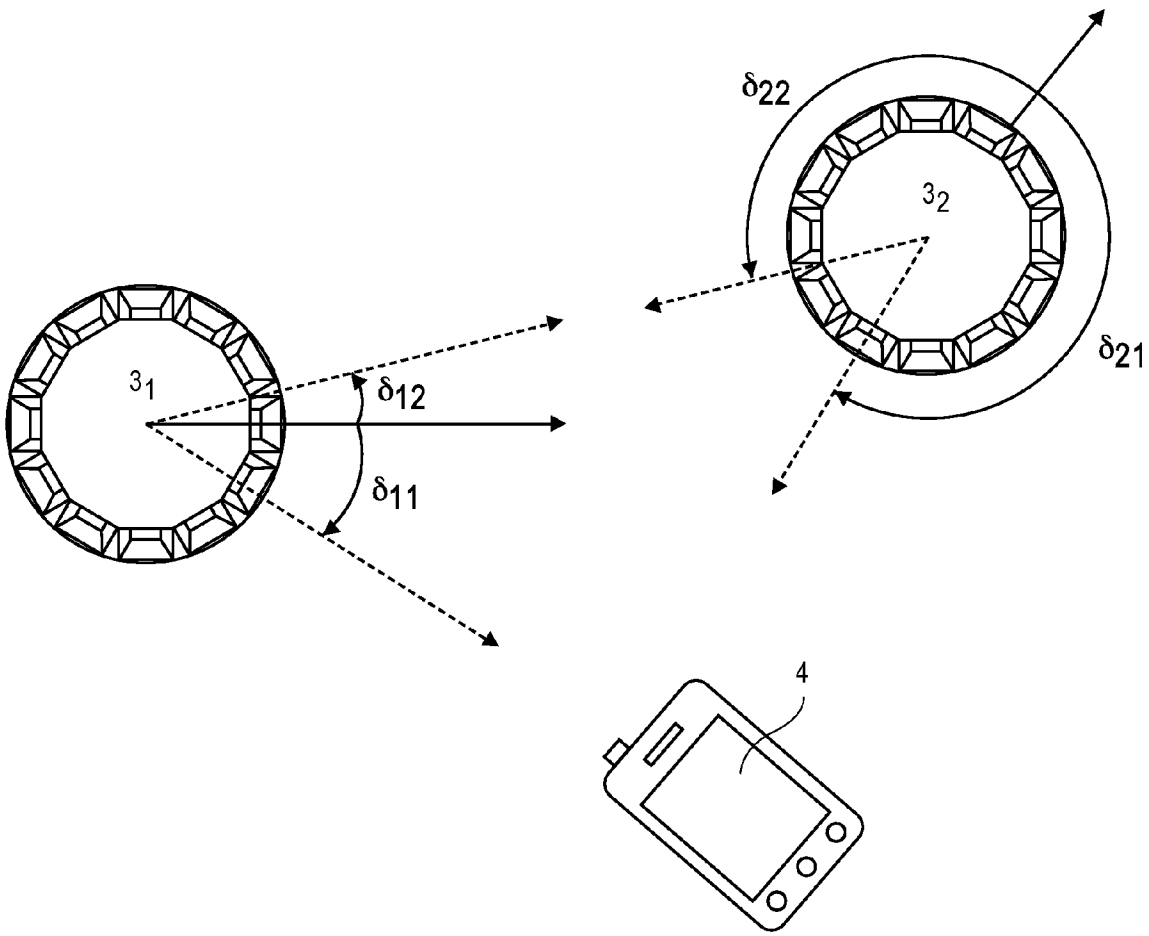
FIG. 9 shows two loudspeaker arrays and each array's relationships to each other and to the listening device according to one embodiment.

In one embodiment, multiple loudspeaker arrays 3 may be used to determine orientation. For example, as shown in FIG. 9 two loudspeaker arrays $\mathbf{3}_1$ and $\mathbf{3}_2$ are positioned in the listening area 1 along with the listening device 4. Using a similar technique to those described above, the audio receiver 2 may drive each transducer 5 in the loudspeaker arrays $\mathbf{3}_1$ and $\mathbf{3}_2$ to produce separate beam patterns corresponding to separate orthogonal audio signals 8. Based on corresponding sounds produced by each beam pattern corresponding to these orthogonal audio signals 8, the orientation of the loudspeaker arrays $\mathbf{3}_1$ and $\mathbf{3}_2$ may be determined. The resulting orientation may be relative to the listening device 4 and/or the other loudspeaker array $\mathbf{3}_1$ and $\mathbf{3}_2$. For example, azimuthal measurements $\delta_{11}$ and $\delta_{12}$ for loudspeaker array $\mathbf{3}_1$ may correspond to the orientation of the loudspeaker array $\mathbf{3}_1$ relative to the listening device 4 and the loudspeaker array $\mathbf{3}_2$. Similarly, azimuthal measurements $\delta_{21}$ and $\delta_{22}$ for loudspeaker array $\mathbf{3}_2$ may correspond to the orientation of the loudspeaker array $\mathbf{3}_2$ relative to the listening device 4 and the loudspeaker array $\mathbf{3}_1$. The azimuthal measurements δ may be relative to a particular quadrant or another portion of the loudspeaker arrays 3. In one embodiment, the loudspeaker arrays $\mathbf{3}_1$ and $\mathbf{3}_2$ may each include microphones 26. In this embodiment, the loudspeaker arrays $\mathbf{3}_1$ and $\mathbf{3}_2$ may act as the listening device 4 to assist in determining the orientation of the other loudspeaker array 3.

In one embodiment, the time of arrival between each of the orthogonal audio signals 8 from multiple loudspeaker arrays 3 may be used to improve on the above orientation estimates. For example, sound corresponding to an orthogonal audio signal 8 output by loudspeaker array $\mathbf{3}_1$ may be received at time $t_1$, whereas sound corresponding to an orthogonal audio signal 8 output by loudspeaker array $\mathbf{3}_2$ may be received at time $t_2$. Based on these times, the distance between the loudspeakers $\mathbf{3}_1$ and $\mathbf{3}_2$ may be determined using the following equation:

$$t_2 - t_1 = \frac{d_2 - d_1}{c}$$

Where c is the speed of sound in air and $d_1$ and $d_2$ are the distances between the loudspeakers $\mathbf{3}_1$ and $\mathbf{3}_2$ and the listening device 4, respectively.

The method 28 allows for the simultaneous examination of multiple transducers 5 on separate sides or directions of a loudspeaker array 3 through the use of orthogonal test signals 8. By analyzing multiple transducers 8 and directions of the loudspeaker array 3 simultaneously, the method 28 allows for a more accurate orientation determination in a greatly reduced period of time in comparison to sequentially driving the transducers 5. By quickly determining orientation of the loudspeaker array 3 relative to the listening device 4, immediate and continual adjustment of sound produced by the loudspeaker array 3 may be performed. For example, the audio receiver 2 may adjust one or more beam patterns emitted by the loudspeaker array 3 upon determining that the listening device 4 (and by inference the listener/user) is seated to the left of the loudspeaker array 3. Driving all of the transducers 5 in the loudspeaker array 3 simultaneously and accordingly taking all of the measurements simultaneously also avoids problems due to the movement of the listening/measurement device 4 between measurements, because all measurements are taken at the same time.

Further, by using orthogonal test signals 8, the method 28 for determining orientation of the loudspeaker array 3 is more robust to extraneous sounds. For example, the audio receiver 2 may determine orientation of the loudspeaker array 3 while simultaneously playing an audio track without affecting the orientation determination process.

As explained above, an embodiment of the invention may be an article of manufacture in which a machine-readable medium (such as microelectronic memory) has stored thereon instructions which program one or more data processing components (generically referred to here as a "processor") to perform the operations described above. In other embodiments, some of these operations might be performed by specific hardware components that contain hardwired logic (e.g., dedicated digital filter blocks and state machines). Those operations might alternatively be performed by any combination of programmed data processing components and fixed hardwired circuit components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. A method for determining an orientation of an audio output device that houses multiple transducers, comprising:

driving the multiple transducers housed in the audio output device to simultaneously emit multiple beam patterns from the audio output device, wherein each beam pattern is driven using a separate orthogonal audio signal and emitted from a different quadrant of the audio output device;

receiving a sensed audio signal from a listening device that senses sound produced by the multiple beam patterns to produce the sensed audio signal;

producing a plurality of cross-correlation signals by convolving each separate orthogonal audio signal with the sensed audio signal to generate a cross-correlation signal for each quadrant of the audio output device; and determining the orientation of the audio output device relative to the listening device based on the cross-correlation signals.

2. The method of claim 1, wherein quadrants of the audio output device corresponding to the cross-correlation signals with higher peaks are closer to the listening device than quadrants of the audio output device corresponding to the cross-correlation signals with lower peaks.

3. The method of claim 1, wherein quadrants of the audio output device corresponding to the cross-correlation signals with peaks earlier in time are closer to the listening device than quadrants of the audio output device corresponding to the cross-correlation signals with peaks later in time.

4. The method of claim 1, wherein a phase of each beam pattern is analyzed to determine a location of the listening device relative to quadrants of the audio output device.

5. The method of claim 1, wherein the determined orientation of the audio output device includes an azimuthal measurement for each quadrant of the audio output device relative to the listening device.

6. The method of claim 5, wherein the azimuthal measurements are relative to the orientation of the audio output device to the listening device in one of a vertical plane or a horizontal plane.

7. A listening device for determining an orientation of an audio output device that houses multiple transducers, the listening device comprising:

a microphone for sensing sounds produced by multiple beam patterns simultaneously emitted by the multiple transducers housed in the audio output device when driven by orthogonal audio signals, each of the multiple beam patterns being emitted from a different side of the audio output device to produce a sensed sound signal; and an orientation determination unit for retrieving the orthogonal audio signals, convolving each orthogonal audio signal with the sensed sound signal to generate a cross-correlation signal for each side of the audio output device, and determining the orientation of the audio output device relative to the listening device based on the cross-correlation signals.

8. The listening device of claim 7, further comprising:

a memory unit for storing the orthogonal audio signals and each orthogonal audio signal's association with separate sides of the audio output device.

9. The listening device of claim 7, wherein sides of the audio output device corresponding to the cross-correlation signals with higher peaks are closer to the listening device than sides of the audio output device corresponding to the cross-correlation signals with lower peaks.

10. The listening device of claim 7, wherein sides of the audio output device corresponding to the cross-correlation signals with peaks earlier in time are closer to the listening device than sides of the audio output device corresponding to the cross-correlation signals with peaks later in time.

11. The listening device of claim 7, wherein a phase of each beam pattern is analyzed to determine a location of the listening device relative to sides of the audio output device.

12. The listening device of claim 7, further comprising:

a network adapter for communicating with the audio output device to synchronize the orthogonal audio signals.

13. The listening device of claim 7, wherein the determined orientation of the audio output device includes an azimuthal measurement for each side of the audio output device relative to the listening device.

14. The listening device of claim 7, wherein the listening device is a mobile phone.

15. A non-transitory machine-readable storage medium that stores instructions which, when executed by data processing system cause the system to perform a method as in any one of claim 1 and claims 2-6.

* * * * *